US006753647B2

(12) United States Patent
Kim

(10) Patent No.: US 6,753,647 B2
(45) Date of Patent: Jun. 22, 2004

(54) COMPOSITION OF GETTER AND FIELD EMISSION DISPLAY USING THE SAME

(75) Inventor: Yong Churl Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/167,388

(22) Filed: Jun. 13, 2002

(65) Prior Publication Data

US 2003/0001499 A1 Jan. 2, 2003

(30) Foreign Application Priority Data

Jun. 13, 2001 (KR) ..... 2001/33096

(51) Int. Cl.[7] ..... H01J 19/70

(52) U.S. Cl. ..... 313/561; 313/553; 313/495; 252/181.7

(58) Field of Search ..... 313/561, 553, 313/495, 496, 497; 252/181.1, 181.6; 417/48–51

(56) References Cited

U.S. PATENT DOCUMENTS

| | | | | |
|---|---|---|---|---|
| 3,308,329 A | | 3/1967 | Foreman et al. | 313/107 |
| 4,977,035 A | * | 12/1990 | Travis et al. | 428/550 |
| 5,180,568 A | | 1/1993 | Boffito et al. | 423/248 |
| 6,077,141 A | | 6/2000 | Meyer et al. | 445/25 |
| 6,186,849 B1 | * | 2/2001 | Corazza | 445/24 |
| 6,299,746 B1 | * | 10/2001 | Conte et al. | 204/298.07 |

FOREIGN PATENT DOCUMENTS

| | | | | |
|---|---|---|---|---|
| DE | 19714654 A | | 10/1998 | |
| EP | 0977469 A2 | | 2/2000 | |
| EP | 0996141 A2 | | 4/2000 | |
| JP | 04-259348 | * | 9/1992 | C22C/23/00 |
| JP | 8196899 | | 8/1996 | |
| WO | WO 97/29503 | | 8/1997 | |
| WO | WO98/43269 | | 10/1998 | |
| WO | WO98/43763 | | 10/1998 | |

OTHER PUBLICATIONS

A.N. Perevezentsev et al. "Absorption Kinetics and Dynamics of Gaseous Impurities in Helium and Hydrogen by Intermetallic Compounds".

* cited by examiner

*Primary Examiner*—Nimeshkumar D. Patel
*Assistant Examiner*—Karabi Guharay
(74) *Attorney, Agent, or Firm*—Fleshner & Kim, LLP

(57) ABSTRACT

A composition of a getter and a field emission display (FED) using the same are disclosed which are capable of improving a degree of vacuum and a gas rejection capability by performing an activation process by using a getter that can lower an activation temperature. The composition of the getter comprises chrome and the field emission display contains the getter having chrome as a main component.

16 Claims, 8 Drawing Sheets

COMPOSITION OF GETTER AND FIELD EMISSION DISPLAY USING THE SAME

BACKGROUND OF THE INVENTION

1. Field of the Invention

The present invention relates to a composition of a getter, and more particularly, to a composition of a getter and a field emission display using the same that is capable of lowering a temperature of an activation.

2. Description of the Background Art

In general, recently, various flat panel displays are being developed to reduce a weight and a volume, the shortcomings of a cathode ray tube (CRT).

The flat panel displays include a liquid crystal display (LCD), a field emission display (FED), a plasma display panel, an electro-luminescence (EL), and the like. In order to improve a display quality, researches are being actively conducted to heighten a luminance, a contrast and a colorimetric purity of the flat panel display.

The FED is classified into a tip type FED in which a high electric field is concentrated on an acuminate emitter to emit electrons by a quantum mechanical tunnel effect, and a metal insulator metal (MIM) FED in which a high electric field is concentrated on a metal having a certain area to emit electrons by the quantum mechanical tunnel effect.

FIG. 1 is a perspective view of a tip type field emission display in accordance with a conventional art, and FIG. 2 is a sectional view of the tip type FED in accordance with the conventional art.

As shown in FIGS. 1 and 2, the FED includes an upper glass substrate 2 on which an anode electrode 4 and a fluorescent material 6 are stacked; and a field emission array 32 formed on the lower glass substrate 8.

The field emission array 32 includes a cathode electrode 10 and a resistance layer 12 sequentially formed on the lower substrate 8, a gate insulation layer 14 and an emitter 22 formed on the resistance layer 12, and a gate electrode 16 formed on the gate insulation layer 14.

The cathode electrode 10 supplies current to the emitter 22, and the resistance layer 12 restricts an overcurrent applied to the emitter 2 from the cathode electrode 10 in order to supply a uniform current to the emitter 22.

The gate insulation layer 14 insulates the cathode electrode 10 and the gate electrode 16.

The gate electrode 16 is used as a fetch electrode for fetching electrons.

A spacer 40 is installed between the upper glass substrate 2 and the lower glass substrate 8.

The spacer 40 supports the upper glass substrate 2 and the lower glass substrate 8 so that a high vacuum state can be maintained between the upper glass substrate 2 and the lower glass substrate 8.

For example, in order to display a picture, a negative polarity (−) cathode voltage is applied to the cathode electrode 10 and a positive polarity (+) anode voltage is applied to the anode electrode 4. And, a positive polarity (+) gate voltage is applied to the gate electrode 16.

Thereafter, electron beams 30 emitted from the emitter 22 collide with the fluorescent material 6 of red, green blue colors to excite the fluorescent material (phosphor). At this time, a visible ray of one of red, green and blue colors is luminescent. In this respect, in order to control each pixel, the FED is formed with a matrix structure as shown by the portion 'A' of FIG. 1.

FIG. 3 is a perspective view showing a gate structure of the FED in accordance with the conventional art, that is, a perspective view showing a gate structure formed in the matrix structure.

First, the cathode electrode 10 and the gate electrode 16 are electrically insulated by the gate insulation layer 14 and formed to cross each other in a horizontal or in a vertical direction.

Gate holes 36 are formed at the gate electrode 16 and emitters 22 corresponding to each gate hole 36 are formed on the cathode electrode 10.

Thereafter, when the cathode electrode 10 is grounded and some +100V voltage is applied to the gate electrode 16, a high electric field is generated at the end portions of the emitters 22 positioned at the part where the two electrodes 10 and 16 cross each other, and electrons 30 are emitted by the high electric field.

At this time, the voltage of the gate electrode 16 is lowered down as the size of the gate hole 36 is reduced, and the voltage of the gate electrode 16 differs depending on the characteristics of the material of the emitter 22. And, by applying a voltage sequentially to the cathode electrodes 10 and the gate electrodes 16, electrons 30 are emitted from the emitter 22 at the point where the two electrodes 10 and 16 cross each other so that the fluorescent material 6 is excited and accordingly light can be emitted from the pixels.

For example, a high pressure of above a few kV is applied to the anode electrode 4 coated with the fluorescent 6 thereon, in order to accelerate the electrons 30 emitted from the emitter 22 so that the electrons are collide with the fluorescent material 6.

At this time, as for the luminance of each pixel and color implementation, the luminance of the pixel can be controlled by using a principle that the amount of current differs according to a voltage difference applied between the emitter 22 and the gate electrode 16 and the color can be implemented by controlling the luminance of the three pixels of adjacent red, green and blue.

The electric field emission space inside the panel of the FED should be maintained in a high vacuum state of above $10^{-5}$ Torr in view of its driving characteristics.

That is, the emitter 22 and the gate electrode 16 are separated with a space of about a sub-micron therebetween, into which a high electric field of about $10^7$ V/cm is applied.

At this time, unless the space between the emitter 22 and the gate electrode 16 is maintained in the high vacuum state, the voltage between the emitter 22 and the gate electrode 16 may be emitted or an insulator destruction phenomenon may occur.

In addition, unless the electric field emission space is maintained in the high vacuum state, neutral particles existing inside the panel collide with the electrons to generate positive ions.

The generated positive ions collide with the emitter 22 to degrade the emitter 22 or collide with the electrons 30 to reduce an acceleration energy of the electrons 30 to degrade the luminance.

Thus, in order to improve the luminance, a vacuum process is necessary to make inside the panel to be in a high vacuum state during the fabrication process of the FED.

FIG. 4 is a sectional view showing a panel structure of the FED in accordance with the conventional art. That is, FIG. 4 is to show the getter. Descriptions for constructions repeatedly shown in FIGS. 1 and 3 are omitted.

As shown in FIG. 4, the panel of the FED includes an upper glass substrate 2 on which the anode electrode 4 and the fluorescent material 6 are stacked; a cathode electrode 10 and an insulation layer 14; a gate electrode 16 formed on the insulation layer 14; a lower glass substrate 8 with a focussing insulation layer (not shown) formed on the gate electrode 16; and a glass frit seal 38 supporting the upper glass substrate 2 and the lower glass substrate 8.

In addition, a getter 34 is formed inside the panel to absorb a gas generated during the FED fabrication process before the upper glass substrate 2 and the lower glass substrate 8 are attached.

The getter 34 is classified into an evaporable getter (EG) and a non-evaporable getter (NEG).

Barium is used as a material of the EG, and the EG is used for a cathode-ray tube forming a television screen and a computer screen. That is, the barium getter is evaporated by an external heating from an inner wall of the cathode-ray tube and used to remove a residual gas inside the cathode-ray tube as a metal film form.

In this respect, barium exists as a precursor of $BaAl_4$+Ni before activation, and the activation process is performed when the precursor of barium is evaporated by the external heating.

Substantially, a mixture of powder of the composition $BaAl_4$ and power of nickel is used as the precursor of the barium film.

Nickel is reacted with aluminum at a temperature of about 850° C. and the heat generated by the reaction evaporates barium according to a 'fresh' phenomenon.

However, the conventional art has problems that the structure for forming the EG inside the panel of the FET is complicated and when the EG is activated, the internal temperature goes up to 800~1250° C. Thus, in case of the thin film display such as the FED, it is difficult to maintain the degree of vacuum since the substrate is damaged.

Meanwhile, the NEG uses titanium (Ti), Zirconium (Zr), or the like, as a main component and formed by adding other metals such as aluminum (Al), nickel (Ni), Cobalt (Co) or ferrite (Fe) and oxide.

The NEG heightens the degree of vacuum by removing a residual gas in a light bulb or an FED and used in various application field such as extension of durability of a device.

In the activation process of the NEG, after compressed and sintered power particles are combined, when they are first exposed in the air, a thin film of an oxide, a carbide and a nitride formed at the surface of the powder particles is removed.

In the activation process of the NEG, the material such as the oxide, the carbide and the nitride is heated to diffuse oxygen, carbon and nitrogen into the getter material, and then, the surface of the metal of the pure NEG, being in the activated state available for a gas adsorption, is exposed.

An activation temperature of the NEG depends on a composition. For example, a ST-707 produced and sold by SAES Getters of Italy is formed by activating an alloy of 70 weight % Zr, 24.6 weight % V and 5.4 weight % Fe at a temperature of 350° C., and a st-101 is formed by activating an alloy of 84 weight % Zr and 26 weight % Al at a temperature of 900° C.

The activation process is preferably performed at a low temperature for a short time in consideration of a damage to a function of a specific device, an energy and a processing cost, and these matters are much required for the thin film type display such as the FED using the glass substrate.

A technique related to the activation process that can be performed at a low temperature is disclosed in a Japanese patent publication No. '8-196899' and an International Patent Number 'PCT/IT 97/00027'.

In the Japanese patent publication No.: 8-196899, an oxidation agent such as titanium (Ti), titanium oxide ($TiO_2$) and a barium oxide ($BaO_2$) is heated by a heater, mixed at a suitable ratio so that a reaction heat can be generated, and then pressurized in order to construct an NEG system of a certain shape.

As for the two oxides ($TiO_2$, $BaO_2$), in order to form $Ti_2O_5$, the intermediate oxide of titanium, titanium is partially oxidized.

The reaction heat according to the oxidation reaction should activate residual titanium, and the mixture is activated at a temperature of 300~400° C.

The International Patent Number 'PCT/IT 97/00027' discloses a composition of a getter comprising oxide selected from the group of $Ag_2O$, CuO and $Co_3O_4$ or their mixture and an alloy.

A third component such as yttrium and lanthanum existing in rare earth elements can be selectively added to the alloy.

In general, among the composition, the getter material requires a high temperature of 350~900° C. for its activation, while the getter device containing all of the compositions can be operated at a temperature of 280~500° C., a comparatively low temperature.

That is, the getter device can be activated at a comparatively low temperature by using a reaction heat using thermodynamic interaction with other element.

However, when the NEG alloy suddenly comes in contact with a large amount of reactive gas, that is, when it is exposed in the air, and when the initial alloy has a melting point of above 200~250° C., the alloy makes a strong exothermic reaction to increase the temperature up to above 1000° C.

Thus, there is a possibility that other portion of the FED panel is damaged, so that it can hardly be adoptable to the thin film display such as the FED or the PDP (plasma display panel; PDP).

SUMMARY OF THE INVENTION

Therefore, an object of the present invention is to provide a composition of is a getter and a field emission display (FED) using the same that are capable of improving a degree of vacuum and a gas rejection capability by performing an activation process by using a getter that can lower an activation temperature.

To achieve these and other advantages and in accordance with the purpose of the present invention, as embodied and broadly described herein, there is provided a composition of a getter of which a main component is Cr. The composition of a getter further comprises titanium (Ti) and Zirconium (Zr). The composition of a getter consists of 40 weight % chrome (Cr), 30 weight % titanium (Ti) and 30 weight % zirconium (Zr).

To achieve the above object, there is also provided a field emission display including a getter having chrome as a main component.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The present invention is featured in that an activation process is performed by using a getter that can lower down an activation temperature, and a preferred embodiment of a composition of a getter that can improve a degree of vacuum and a gas rejection capability and a field emission display using the same will now be described with reference to FIGS. 5 through 11C.

Figure 1:
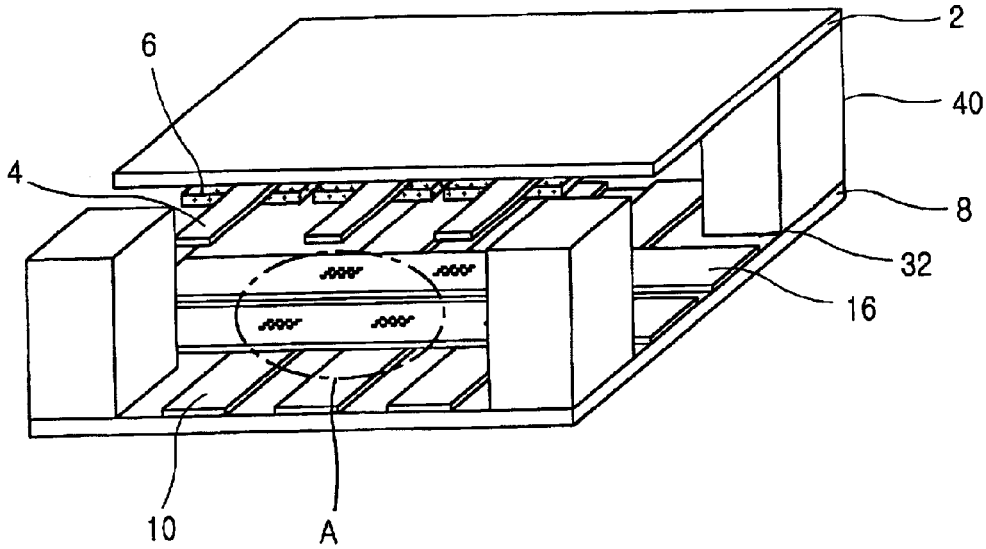
FIG. 1 CONVENTIONAL ART
FIG. 1 is a perspective view of a tip type field emission display (FED) in accordance with a conventional art.
Figure 2:
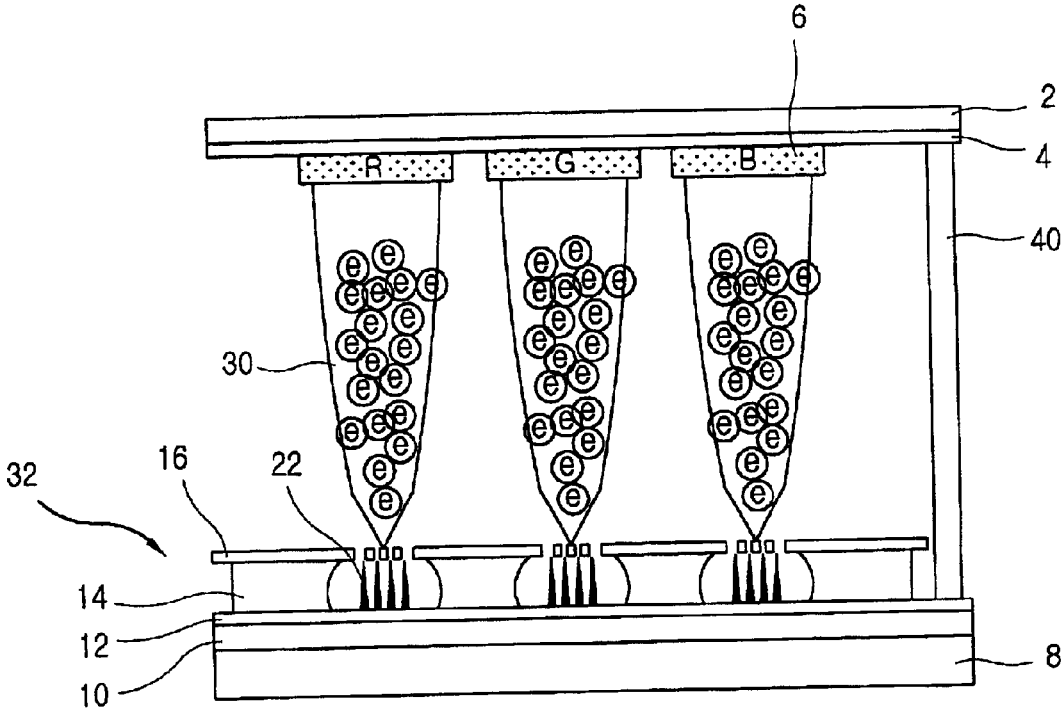
FIG. 2 CONVENTIONAL ART
FIG. 2 is a sectional view of the tip type FED of FIG. 1 in accordance with the conventional art.
Figure 3:
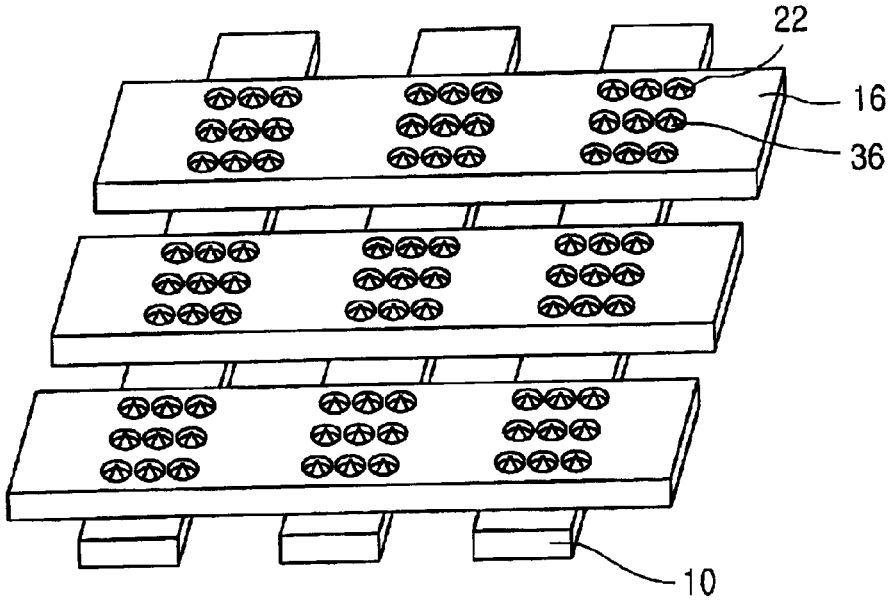
FIG. 3 CONVENTIONAL ART
FIG. 3 is a perspective view showing the structure of a cathode gate of the FED in accordance with the conventional art.
Figure 4:
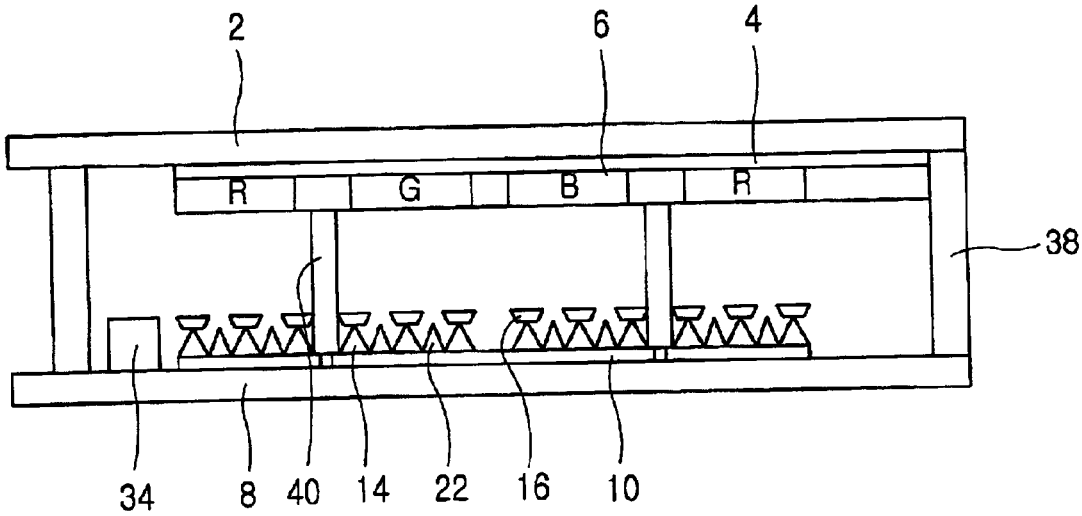
FIG. 4 CONVENTIONAL ART
FIG. 4 is a sectional view showing a panel structure of the FED in accordance with the conventional art.
Figure 5:
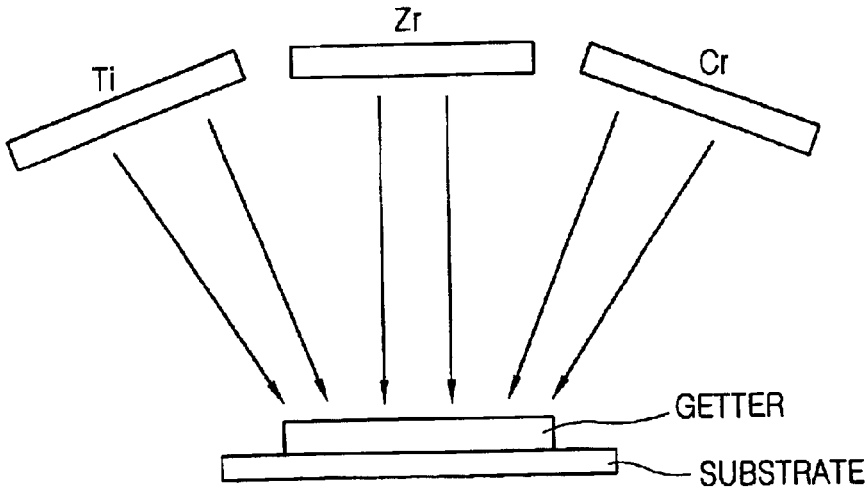
FIG. 5 shows a composition of a getter of an FED in accordance with the present invention.

FIG. 5 shows a composition of a getter of an FED in accordance with the present invention.

As shown in FIG. 5, a composition of a getter of the present invention comprises chrome (Cr), zirconium (Zr) and titanium (Ti). That is, composition of a getter of the Cr—Zr—Ti group and its composition ratio are shown in the below Table 1.

TABLE 1

Composition of the getter of Cr-Zr-Ti group

| Component | Cr | Zr | Ti |
|---|---|---|---|
| Weight % | 20–70 | 20–50 | 0–30 |

The composition ratio of the composition of the getter is calculated on the assumption that the weight of the getter is 100 weight %.

The composition ratio of the composition of the getter is preferably 40 weight % Cr, 30 weight % Zr and 30 weight % Ti. And, at this time, the getter is formed as a sputtering type or a bulk type. A method for fabricating the sputtering type getter and the bulk type getter will now be described with reference to FIGS. 6 and 7.

Figure 6:
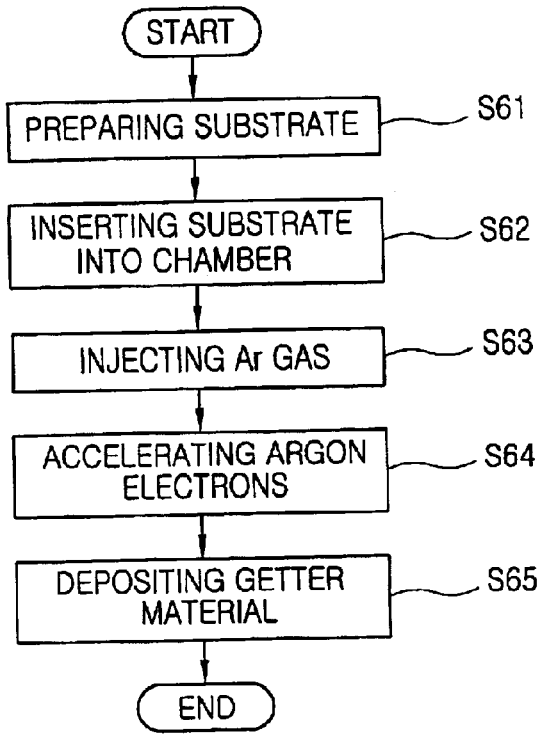
FIG. 6 is a flow chart of thin film type getter fabricating method of the FED.

FIG. 6 is a flow chart of sputtering type getter fabricating method of the FED.

First, one of upper substrate and lower substrate is prepared (step S61).

Second, the prepared substrate is mounted in a chamber in a vacuum state (step S62).

Third, argon (Ar), a non-active gas, is injected between the getter material, Cr, Zr and Ti, and the anode electrode. In this respect, the composition of the getter and the anode electrode are installed in the chamber (S63).

Fourth, argon (Ar) is excited by using plasma. At this time, argon electrons (Ar+) inside the chamber are accelerated by the high voltage generated by the excited argon electrons (Ar+) (step S64).

Fifth, getter materials, sprung up as the argon electrons (Ar+) accelerated in the chamber are the composition (Cr—Zr—Ti group) of the getter collide with each other, are deposited on the prepared substrate with a thickness of 0.01~10 $\mu$m. That is, the sputtering type getter is formed by depositing the getter materials having the thickness of 0.01~10 $\mu$m on the substrate (step S65).

Figure 7:
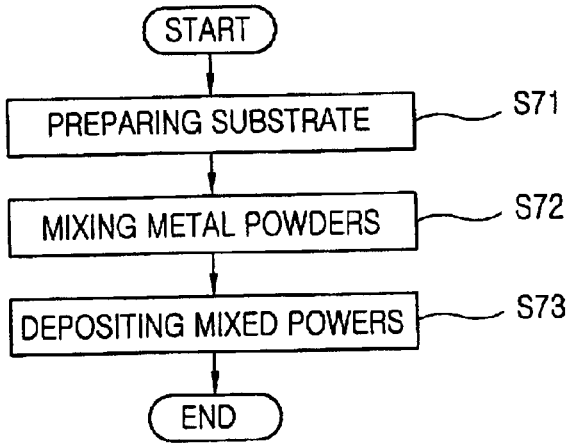
FIG. 7 is a flow chart of a bulk type getter fabricating method of the FED.

FIG. 7 is a flow chart of a bulk type getter fabricating method of the FED.

First, one of an upper substrate and a lower substrate is prepared (step S71).

Second, Cr, Zr and Ti, the composition of getter, are crushed on the prepared substrate to make powders and then the metal powders are mixed step S72).

Third, the mixed metal powders are sintered and then deposited with a particle size of about 1~100 $\mu$m on the prepared substrate. That is, the mixed metal powers are deposited with the particle size of 1~100 $\mu$m on the substrate, thereby forming a bulk type getter (step S73).

Figure 8A:
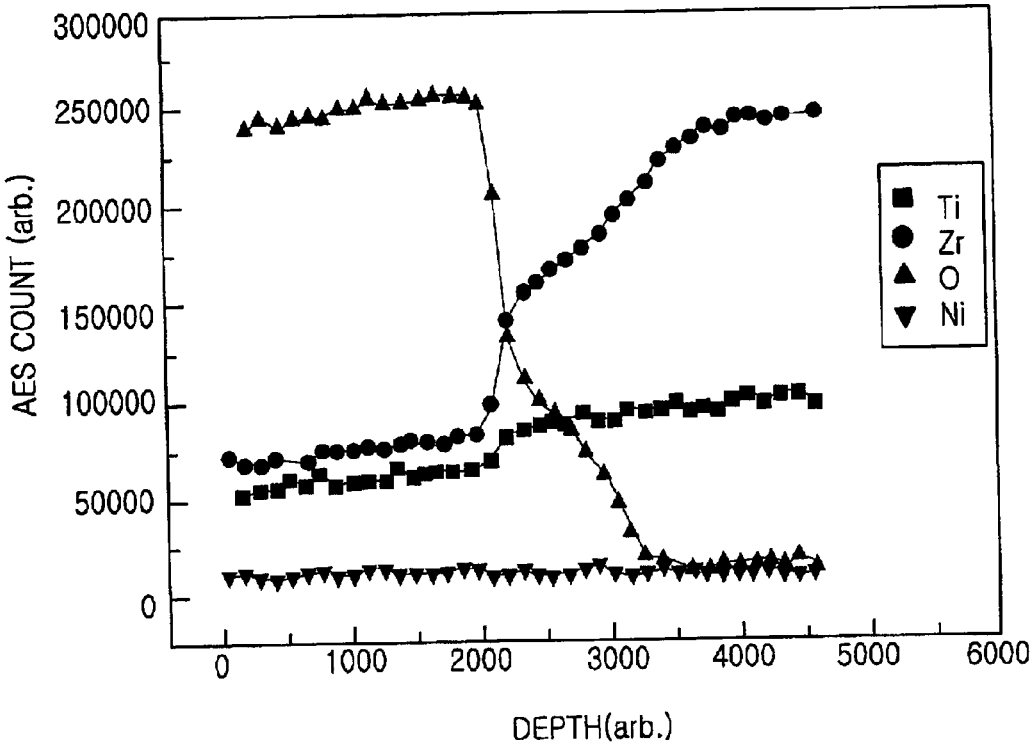
FIGS. 8A and 8B are graphs showing an oxygen rejection capability of a getter in accordance with the conventional art and the present invention.
Figure 8B:
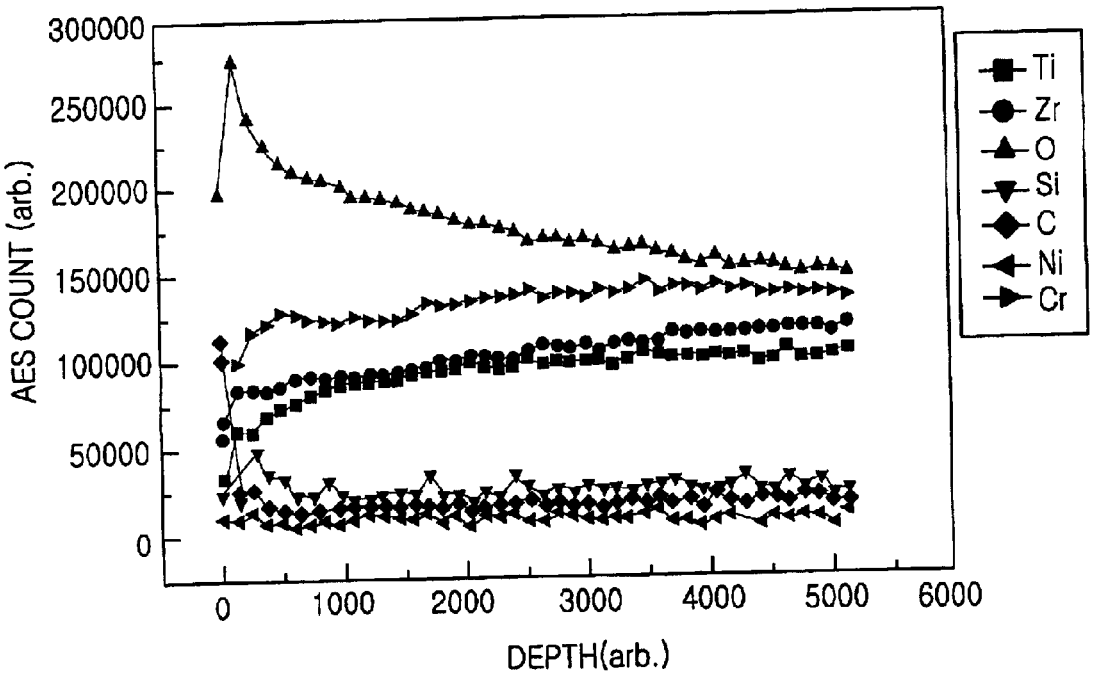

FIGS. 8A and 8B are graphs showing an oxygen rejection capability of a getter in accordance with the conventional art and the present invention.

That is, FIGS. 8A and 8B show the oxygen rejection capability of the getters in accordance with the conventional art and the present invention by using an auger electron spectroscopy (AES) spectrum under the thermal treatment condition of a temperature of 300° C. for 1 hour in the atmosphere.

The AES is surface analyzing equipment by which, after electron beams focussed with a size of hundreds of armstrong are made incident on the surface of the getter, the energy of the emitted auger electrons is measured to thereby analyze the type and amount of the element constructing the surface of the getter.

As shown in FIG. 8A, the lateral axis of the graph indicates a depth from the surface of the getter and the longitudinal axis of the graph indicates the composition of the getter or the amount of the impurity absorbed into the getter.

For example, in the conventional art, the amount of oxygen absorbed into the getter formed by 70 weight % Zr and 30 weight % Ti is much discovered from the surface of the getter to about 2000 arb. but the oxygen is sharply reduced from there (2000 arb.) and oxygen is little found from above about 3000 arb.

Meanwhile, as shown in FIG. 8B, as having been absorbed into the getter comprising 40 weight % Cr, 30 weight % Ti and 30 weight % Zr components, a large amount of oxygen exists from the surface of the getter up to above about 5000 arb. Thus, it is noted that more amount of oxygen than in the conventional art can be absorbed.

Accordingly, as for the activation temperature and activation time, the composition of getter of the present invention is sufficiently activated at the temperature of 300° C. for 1 hour of the above experiment conditions.

Figure 9:
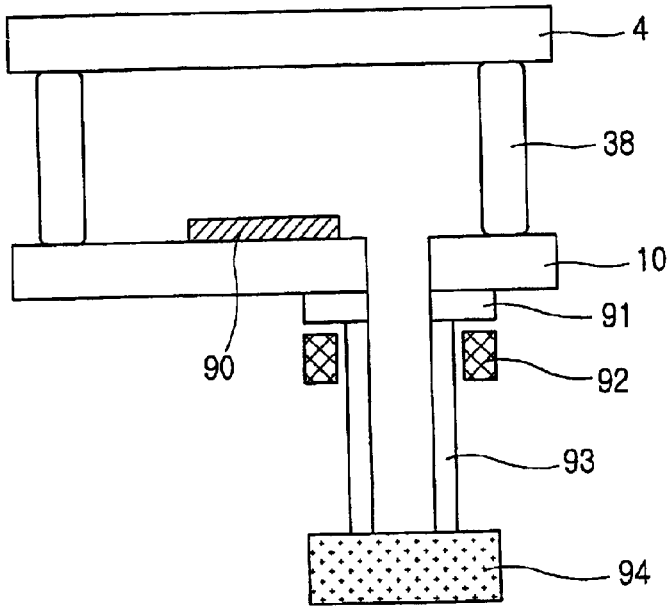
FIG. 9 shows a pump connection to the FED in accordance with the present invention.

FIG. 9 shows a pump connection to the FED in accordance with the present invention.

As shown in FIG. 9, in order to remove impurities inside the panel which has been sintered and bonded, the panel is heated by a local heating unit 92 to exhaust gas inside the panel outwardly by using a pump 94.

While the gas is exhausted from inside the panel outwardly of the chamber, when the degree of vacuum inside the panel reaches a desired level, the middle portion of an exhaust tube 93 is heated and then cut out through a pinch-off process. That is, the chamber of the panel is isolated from the outside.

At this time, a pressure according to the degree of vacuum required for the panel of the conventional art is $2.2\times10^{-4}$ torr while a pressure according to the degree of vacuum required for the panel of the present invention is $4\times10^{-4}$ torr.

Functions of the anode 4, the cathode 10 and the glass frit seals 38 and 91 shown in FIG. 9 are the same as in the conventional art, of which descriptions are, therefore, omitted.

Meanwhile, when performing the pinch-off process, the internal degree of vacuum of the closed panel in a state that the impurities has been discharged from the device inside the panel, is reduced again due to a reason such as an exhaust gas. Thus, in order to increase the degree of vacuum, the getter 90 is activated at a temperature of 300° C. for 3 hours, which will now be described in detail with reference to FIGS. 10A and 10B.

Figure 10A:
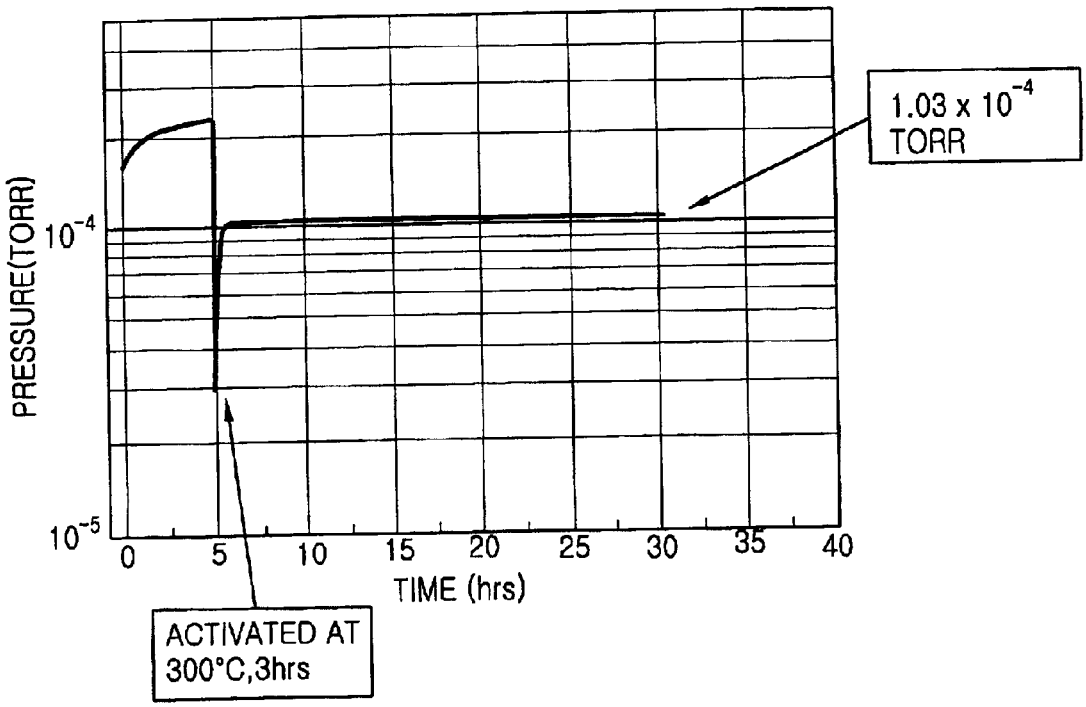
FIGS. 10A and 10B are graphs showing vacuum recover degree of the FED coated with a getter material in accordance with the conventional art and the present invention.
Figure 10B:
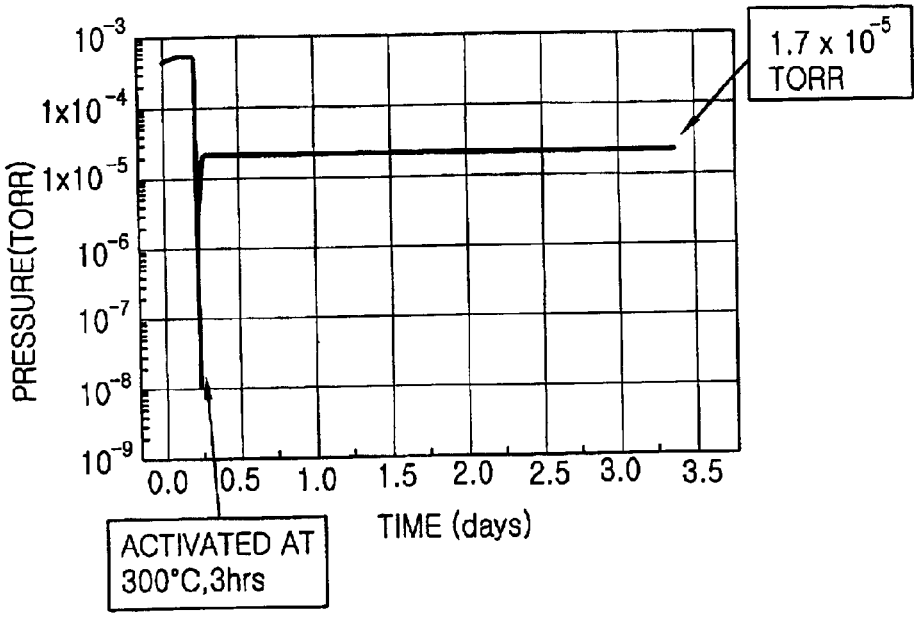

FIGS. 10A and 10B are graphs showing vacuum recover degree of the FED coated with a getter material in accordance with the conventional art and the present invention.

As shown in FIG. 10A, in the conventional art, the getter comprising 30 weight % Ti and 70 weight % Zr is activated at the temperature of 300° C. for 3 hours, the pressure according to the degree of vacuum of the panel is restored to $1.03\times10^{-4}$ torr.

Meanwhile, as shown in FIG. 10B, in case that the getter 90 comprising 40 weight % Cr, 30 weight % Ti and 30 weight % Zr is activated at the temperature of 300° C. for three hours, the pressure according to the degree of vacuum of the panel is restored to $1.7\times10^{-5}$ torr, about 6 times higher than that of the conventional art, to complete the final panel.

Figure 11A:
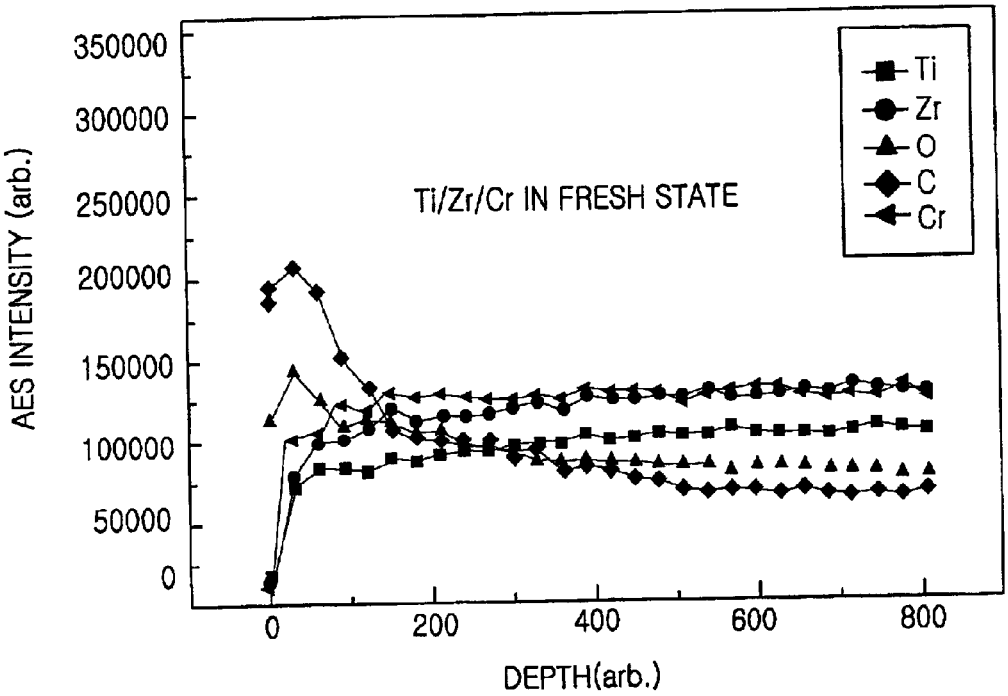
FIGS. 11A through 11C are graphs showing an oxygen rejection capability of the getter from a fresh state to a sealing step and to an activation step in accordance with the present invention.
Figure 11B:
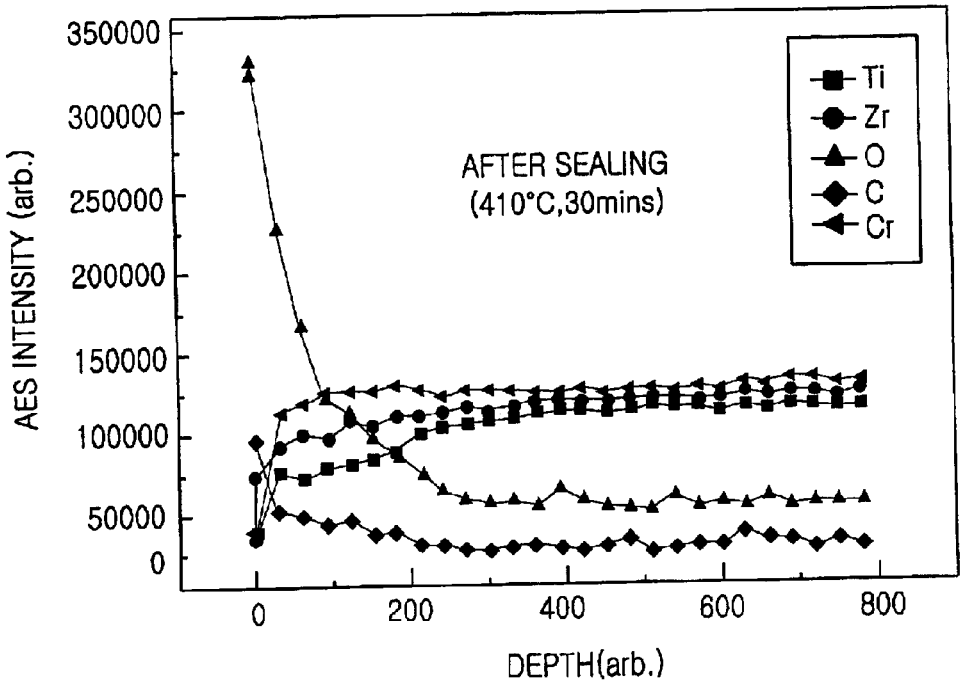
Figure 11C:
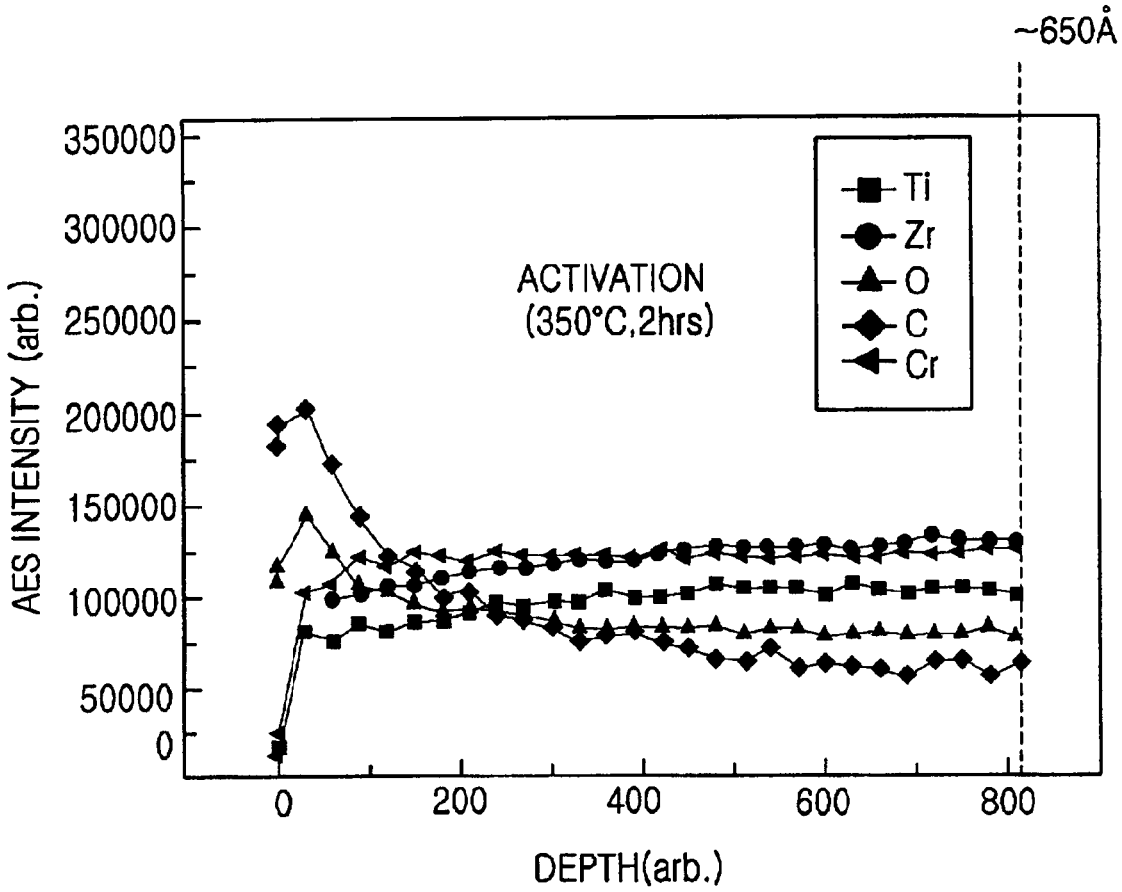

FIGS. 11A through 11C are graphs showing an oxygen rejection capability of the getter from a fresh state to a sealing step and to an activation step in accordance with the present invention.

As shown in FIGS. 11A through 11C, the composition of a getter is deposited through the activation process of about three hours at the temperature of about 300° C. and exposed in the air, or oxygen adsorbed on the surface of the getter is moved into the getter through a high temperature sealing process, so as to have the same state as the surface of the getter in the fresh state. This can be obviously noted through the auger electron spectroscopy spectrum as shown in FIGS. 11A through 11C.

The FED using the getter of the present invention includes: an upper glass substrate 2 on which the anode electrode 4 with the fluorescent material 6 coated thereon is stacked; a lower glass substrate 8; a cathode electrode 10 formed on the lower glass substrate; a resistance layer 12 formed on the cathode electrode 10; an insulation layer 14 formed on the resistance layer 12; a gate electrode 16 formed on the insulation layer 14; an emitter 22 formed on the insulation layer 14; a focussing insulation layer formed on the gate electrode 16; and a getter 90 formed between the upper glass substrate 2 and the lower glass substrate 8 and comprising the group of Ct—Ti—Zr.

The emitter emits electrons according to a voltage applied from the cathode, and the gate electrode fetches electrons from the emitter. The anode is formed facing the cathode.

Except for the getter 90, the other constructions of the FED is the same as in the conventional art, of which descriptions are, thus, omitted.

As so far described, the composition of a getter and the FED using the getter of the present invention has many advantages.

That is, for example, first, since the oxygen rejection capacity of the getter having Chrome as a main component is improved, the activation energy becomes small compared with that of the conventional art. That is, as the activation energy becomes small, the activation process can be performed at a low temperature of below 300° C., and the pressure according to the gas rejection capability and the degree of vacuum is improved by about 6 times that of the conventional art.

In addition, the getter having chrome as the main component can be easily formed as a sputtering type or the bulk type without having such an existing complicate stacking structure or a porous forming process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A composition of a getter comprising:

20 atomic %~70 atomic % chromium (Cr);

titanium (Ti), wherein the Ti is ≦30 atomic %; and 20 atomic %~50 atomic % zirconium (Zr).

2. The composition of claim 1, wherein the getter consists of 40 atomic % chromium, 30 atomic % titanium and 30 atomic % zirconium.

3. The composition of claim 1, wherein said composition is activated at a temperature below 300° C. and improves vacuum and gas reaction capability of said getter.

4. A field emission display (FED) comprising a getter having a composition ratio of 20 atomic % to 70 atomic % Cr, Ti, and 20 atomic % to 50 atomic % Zr, wherein the Ti is ≦30 atomic %.

5. The FED of claim 4, wherein the getter has a composition ratio of 40 atomic % Cr, 30 atomic % Ti and 30 atomic % Zr.

6. The FED of claim 4, further comprising:

an anode electrode with a fluorescent material coated thereon;

a cathode electrode formed facing the anode electrode;

an emitter for emitting electrons according to a voltage applied from the cathode electrode; and a gate electrode for fetching electrons from the emitter.

7. The FED of claim 4, wherein said getter is activated at a temperature below 300° C. and improves vacuum and gas reaction capability of said getter based on the composition ratio.

8. The FED of claim 4, further comprising a substrate, wherein said getter has a thickness of about 0.01 to about 10 $\mu$m on the substrate.

9. The FED of claim 4, wherein the degree of vacuum required for the FED is $1.7\times10^{-5}$ torr.

10. A getter for a field emission display (FED) comprising:

20 to 70 atomic % Cr;

20 to 50 atomic % Zr; and 0 to 30 atomic % Ti wherein said Ti is greater than 0 atomic %.

11. The getter of claim 10, wherein said Cr is about 40 atomic % of the getter.

12. The getter of claim 10, wherein said Ti is about 30 atomic % of the getter.

13. The getter of claim 10, wherein said Zr is about 30 atomic % of the getter.

14. The getter of claim 10, wherein said Cr is about 40 atomic %, Ti is about 30 atomic % and Zr is about 30 atomic % of the getter.

15. The getter of claim 10, wherein said getter is activated at temperature below 300° C. and improve vacuum and gas reaction capability of said getter based on it material composition.

16. The getter of claim 10, wherein said getter is a bulk getter formed by sintering a mixed metal powder of Cr, Ti, and Zr.

* * * * *